US007186040B2

(12) United States Patent
Günther

(10) Patent No.: US 7,186,040 B2
(45) Date of Patent: Mar. 6, 2007

(54) ARRANGEMENT FOR GENERATION OF A PRINT IMAGE FOR FRANKING AND POSTMARKING MACHINES

(75) Inventor: Stephan Günther, Berlin (DE)

(73) Assignee: Francotyp-Postalia AG & Co., KG, Birkenwerder (DE)

( * ) Notice: Subject to any disclaimer, the term of this patent is extended or adjusted under 35 U.S.C. 154(b) by 223 days.

(21) Appl. No.: 10/945,348

(22) Filed: Sep. 20, 2004

(65) Prior Publication Data

US 2005/0069366 A1 Mar. 31, 2005

(30) Foreign Application Priority Data

Sep. 26, 2003 (DE) ..... 203 14 910 U

(51) Int. Cl.
*B41J 5/00* (2006.01)

(52) U.S. Cl. ..... 400/103; 400/104; 400/76; 705/401; 705/408

(58) Field of Classification Search ..... 400/61, 400/62, 70, 76, 103, 104; 705/401, 403, 705/408; 101/71; 381/101
See application file for complete search history.

(56) References Cited

U.S. PATENT DOCUMENTS

| | | | | |
|---|---|---|---|---|
| 4,746,234 A | | 5/1988 | Harry | 400/120.01 |
| 5,142,482 A | * | 8/1992 | Sansone | 700/221 |
| 5,452,654 A | | 9/1995 | Connell et al. | |
| 5,471,925 A | | 12/1995 | Heinrich et al. | 101/91 |
| 5,617,519 A | * | 4/1997 | Herbert | 358/1.18 |
| 5,707,158 A | | 1/1998 | Hansel et al. | 400/61 |
| 5,726,894 A | * | 3/1998 | Sansone | 705/408 |
| 5,852,813 A | | 12/1998 | Guenther et al. | 705/408 |
| 6,178,410 B1 | | 1/2001 | Kunde et al. | 705/406 |
| 6,265,675 B1 | | 7/2001 | Hübler et al. | 177/25.15 |
| 6,418,422 B1 | | 7/2002 | Guenther et al. | 705/401 |
| 6,698,953 B1 | | 3/2004 | Hertlein | 400/103 |
| 6,853,990 B1 | * | 2/2005 | Thiel | 705/401 |
| 6,895,395 B1 | * | 5/2005 | Blanluet et al. | 705/408 |
| 6,988,021 B2 | * | 1/2006 | Daniels et al. | 700/224 |
| 2004/0215583 A1 | * | 10/2004 | Elliott | 705/408 |

FOREIGN PATENT DOCUMENTS

| | | |
|---|---|---|
| DE | 233 101 | 2/1986 |
| DE | PS 199 13 974 | 8/2000 |
| DE | 0S 198 60 296 | 9/2000 |
| DE | OS 199 11 514 | 9/2000 |
| DE | OS 199 12 807 | 9/2000 |
| DE | OS 199 13 066 | 9/2000 |
| DE | OS 199 25 194 | 12/2000 |
| DE | PS 199 13 065 | 2/2001 |
| DE | PS 199 22 881 | 9/2001 |
| WO | WO 02/37372 | 5/2002 |

* cited by examiner

*Primary Examiner*—Minh Chau
(74) *Attorney, Agent, or Firm*—Schiff Hardin LLP

(57) ABSTRACT

In an arrangement to generate a print image for franking and postmarking machines a control unit electronically controls a printer and storage unit for data that are printed in predetermined sections of the print image. Controlled by the electronic control unit, a selected section is printed with special postal information by the printer in a second position to the left next to a first position. The special postal information characterize a private mail carrier. The electronic control unit of the device is connected with a mail processor that determines data that enable mail piece processing and sorting at the private mail carrier.

12 Claims, 3 Drawing Sheets

ARRANGEMENT FOR GENERATION OF A PRINT IMAGE FOR FRANKING AND POSTMARKING MACHINES

BACKGROUND OF THE INVENTION

1. Field of the Invention

The present invention concerns an arrangement for the generation of a print image for franking and postmarking machines, in particular suitable for the use of franking machines or mail processing machines or computers with mail processing functions (PC frankers) so the carrier requirements can be correspondingly selected.

2. Description of the Prior Art

Since the introduction of electronic (digital) printing in franking machines, variable information for elements of a print image can be quickly and easily exchanged (East German Application 233 101, U.S. Pat. No. 4,746,234).

An arrangement for cliche text portion changing for franking machines is known from the German Utility Model 92 19 183 (U.S. Pat. No. 5,471,925). With a printer module, a fully electronically generated franking image is printed that an electronically exchangeable advertising cliche and a cliche text portion that can be edited via keyboard. The advertisement cliche is located at a second position to the left near a first position, which is provided for the franking.

According to the German Utility Model 295 22 024 (U.S. Pat. No. 5,852,813), an arrangement for data input in a franking machine is known that is equipped with input means and output means that are connected with a processor system. An operation means serves for the input of a command to retrieve an advertisement or information (Carrier-INFO) transmitted during a communication. Other operation means are provided in order to change the appearance of the franking imprint in predetermined regions. The appearance of the stamp image or franking imprint thus can be adapted to the needs of different carriers corresponding to the current requirements.

A further method to generate a print image imprinted on a carrier in a franking machine is known from European Application 762334.

Different security levels can be associated with a print image formed by a number of elements (German OS 199 31 962).

The print image that is typical for frankings contains, from right to left, a value or franking stamp followed by a date or a city stamp. Conventionally, only a first position at the top right of the letter is selected for all mail carriers (German OS 199 13 066).

This position may be shifted to the left in an advantageous manner for large letter formats. In a surface approximately 74 mm long and 30 mm wide that is prescribed for frankings in the upper right corner of an envelope, the German mail AG also allows printing of an advertisement cliche and printing of a shipment type (for example parcel, letter, printed matter or airmail). A print image composed of a number of elements must satisfy the requirements of the respective federally authorized mail carrier, as well as the requirements of private mail carriers. A mail transport of one and the same mail piece via different organizations/services for which different transport task portions have been assigned is also known.

From German OS 199 25 194, a method for postal good processing and a postal good processing system are known wherein a postal item automatically receives at special posting stations, and with staggered postal item processing, beginning with a recording of dispatch data, a machine-readable marking and mail storage at the posting stations. A transport of the marked postal item to a separate issuing station and transfer of the dispatch data associated with the marking ensues via a first (private) mail carrying organization. The separate issuing station has at least one franking device with a storage in which the dispatch data associated with the marking are transferred via a chip card. Based on the dispatch data, franking of the postal item is effected in the issuing station of the first (private) mail carrying organization. It is advantageous that the posting stations only have to be equipped with marking printers but not with more expensive franking printers. The prepayment of the postal item to be transported can ensue according to the tariff of the second carrier, separate from the postal good posting. For a first carrier, this has the advantage that the carrier can negotiate a volume discount with a second carrier for his services to deliver franked postal goods. The first carrier can also negotiate a volume discount with further carriers. The franking device of the issuing station can be adjusted for a number of different carriers. Its supply requires in the issuing station a stacking system with a controllable gate and a number of stacks, with one being assigned to each of the respective carriers. The franking device of the issuing station is programmed to determine the carrier with the most suitable tariff for each carrying job. While the first carrier profits from the tariff difference, the supplying of different carriers for the mail sender has the advantage that the tariffs remain moderate due to competition. The franking device is based on the known franking system Jetmail® by the manufacturer Francotyp Postalia AG & Co.KG, having an automatic supply station (German OS 199 12 807, German PS 199 13 065 and German PS 199 13 974), which is completed by a barcode scanner device (for example of the type LS4100 by the company Datalogic (German OS 199 25 194)). The franking system Jetmail CONCORD® by the manufacturer Francotyp Postalia AG & Co.KG is furthermore composed of a dynamic weighing device scale (German PS 198 33 767=U.S. Pat. No. 6,265,675, German OS 198 60 296 and German PS 199 22 881) that is arranged downstream from the automatic supply and scanning station, and moreover of a franking machine (German OS 197 57 652=U.S. Pat. No. 6,418,422, German OS 199 11 514, German OS 199 13 066 and German OS 199 31 962) that is arranged downstream from the dynamic weighing device. The adjacent stations of the franking system Jetmail CONCORD® are connected with one another by an interface (European Application 875864=U.S. Pat. No. 6,178,410).

In the field of mail processing, efficient systems for address recognition (such as scanner systems with OCR software for the purpose of subsequent sorting of the mailings) are also already available. Suitable equipment for mail sorting systems is known from the companies Siemens, NPI and NEC. Furthermore, systems for barcode labeling are known for the purpose of subsequently sorting, in particular in the case of envelopes.

In connection with the progressive liberalization of the European mail market, market opportunities are created for small vendors that, for example in Germany, predominantly offer their services based on a "D license" as an alternative to the resident mail organizations. Since, with free competition, the price/performance ratio decides the success of an organization, the pressure for efficient processes is enormously high. However, due to their predominantly regional operation, the many smaller so-called "private mail service providers" cannot afford expensive sorting systems with OCR scanner systems for automation of their processes.

SUMMARY OF THE INVENTION

An object of the present invention is to provide a significantly more inexpensive solution for the automation of mail processing.

A further object of the present invention is to process arbitrary mail pieces at a first mail carrier, in particular unsorted mixed mail. A scanning of a pre-printed address in the address field of the mail piece should be enabled at a first mail carrier. An evaluation of the address information should ensue in order to attain sorting information, which for mail pieces sorted at a first mail carrier enables a discount at a second mail carrier. The print image printed at the first mail carrier should offer the possibility to contain sorting information.

The above objects are achieved in accordance with the invention by an arrangement for generating a print image wherein one section of the print image is provided for a pre-payment zone at a first position, and a different section is provided for special postal information to be printed at a second position, whereby the section available for mail specifications can be selected by the carrying organization. The special postal information (marking, date and identifier) can now be imprinted in the section instead of the advertisement cliche at a second position to the left near the first position. Instead of the franking stamp, a logo and sorting information can be printed at the first position. Alternatively, the first position can remain unprinted. Shipment information can be printed at a third position.

That the electronic control unit of the machine can be connected with a mail processor that determines data which enable mail piece processing and sorting at the (private) first mail carrier.

The aforementioned mail processor is formed by a computer and the stations of a franking system, which are operationally connected with one another in order to enable mail piece sorting at the first mail carrier. The computer includes an address evaluation unit.

The stations include at least one scanner module and a transport module that are arranged upstream (for mail terms) of a franking machine. The stations and the franking machines are connected with the computer and can be controlled dependent on the address evaluation unit.

The scanner module enables an OCR scanning of a preprinted address in the address area of the mail piece and allows the address evaluation unit to implement an evaluation of the address information in order to obtain sorting information. A two-stage superimposed speed regulation of the transport of mail pieces ensues in the franking system dependent on the necessary calculation time, and other parameters process speed (million instructions per second).

A second transport module and at least one sorting module are arranged downstream of the franking machine, and the aforementioned stations are connected with the computer and can be controlled dependent on the address evaluation unit. In the second transport module, mail pieces lying on a conveyor belt are transported with a controllable speed to the at least one sorting module.

The mail processor can include a scanner module, two transport modules as well as a number of sorting modules that can be controlled by the computer dependent on the address evaluation unit. In the first transport module, mail pieces situated on a conveyor belt are transported to the franking machine with controllable speed.

DESCRIPTION OF THE PREFERRED EMBODIMENTS

Figure 1:
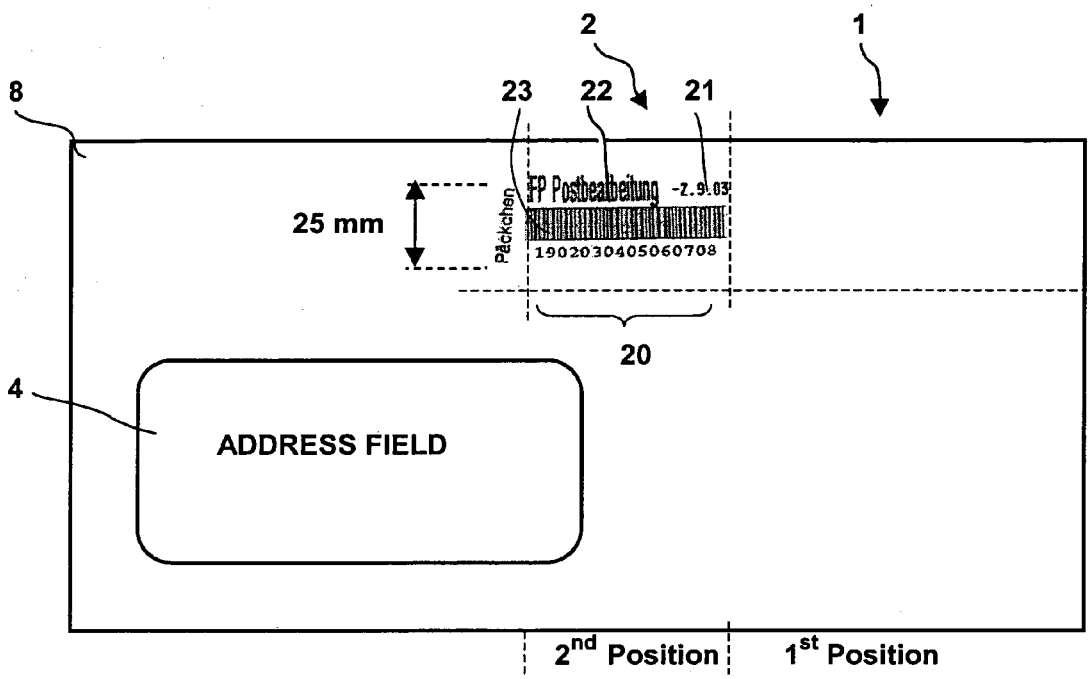
FIG. 1 shows a letter envelope with a print image of a private mail carrier.

FIG. 1 shows a letter envelope with a print image of a private mail carrier printed at a second position by a franking machine. The known franking and postmark machines have electronic control means for activating printer means and storage means for data that are printed in predetermined sections of the print image on a tape or on a mail piece. Means are provided that print (controlled by the electronic control means) a selected section 2 with special postal information 20 with the printer means in a second position to the left next to a first position. The special postal information identify a private mail carrier. The special postal information 20 includes at least one date, a marking 22 for the selected private mail carrier and an identifier 23 for the mail piece, in this case an envelope 8. Selection means are inventively provided and connected with the control means. A first selection means to select the printing of a section of the print image is operated, and as a result of the selection of the printer means the control means causes the respectively selected section 2 or 1, characterizing a private/regional or federal/universal mail carrier, to be printed on a fixed, assigned, predetermined position. As shown in FIG. 1, the respectively selected section 2 characterizing a private mail carrier is printed at a second position. The address field 4 is preprinted, or preferably a window envelope is used as the envelope 8.

Figure 2:
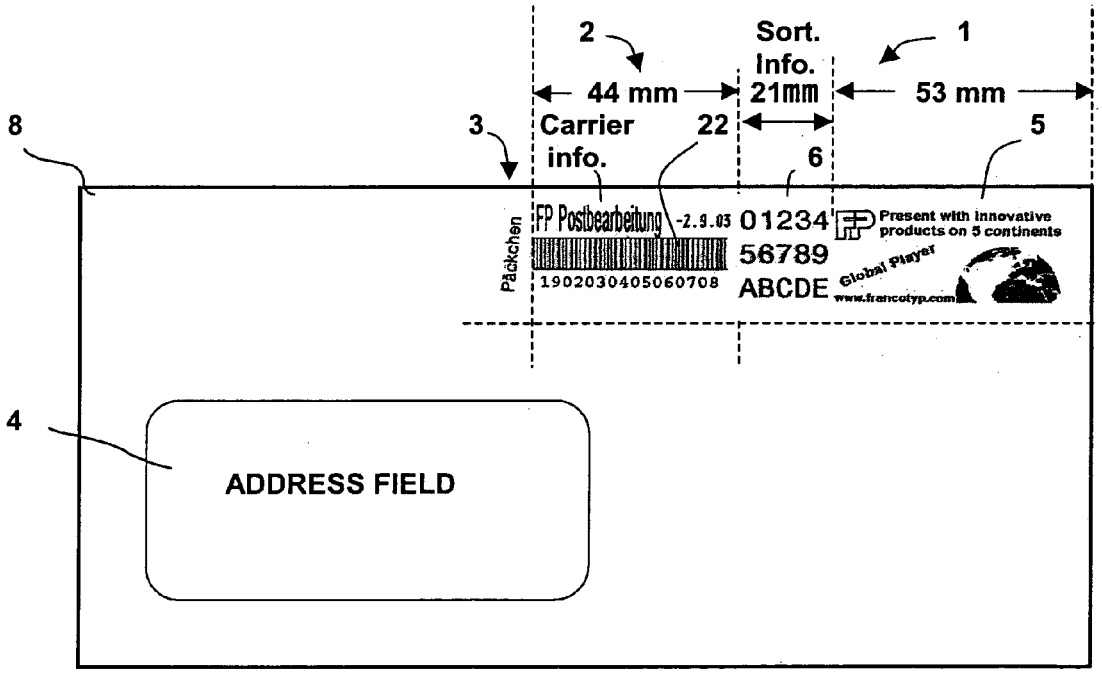
FIG. 2 shows a letter envelope with a print image of a private mail carrier with additional printed information.

FIG. 2 shows a letter envelope with a print image of a private mail carrier with additional printed information (logo, etc.). Such an arrangement of print images results when a private mail carrier effects the transport, sorting and letter delivery. A second selection means is provided to select the printing of a logo 5 and sorting information 6. As a result of the selection of the printer means, the control means causes the logo 5 and the sorting information 6 to be printed at the first position in associated 53 mm and 21 mm fields of the first section.

A third selection means is provided for the selection of the printing from a product code or a shipment type. The control means causes the printing of the aforementioned information in a third section 3 at a third position to the left next to the second position. The printing width for the characterizing carrier information 22 and other special postal information 20 (date 21 and identifier 23) is at least 25 mm and the length is at least 44 mm. The identifier 23 is printed in the form of a barcode and, as necessary, also in the form of alphanumeric characters.

Figure 3:
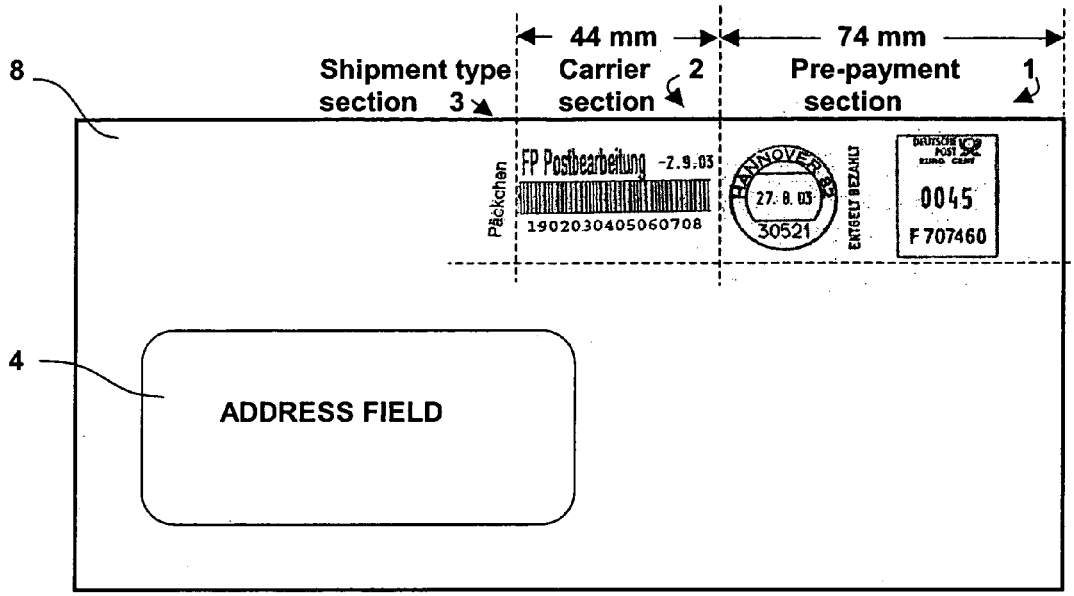
FIG. 3 shows a letter envelope with a print image of federal and private mail carrier.

FIG. 3 shows a letter envelope 8 with a print image of a federal/universal mail carrier (DPAG) printed at a first position and with a print image of a private/regional mail carrier printed at a second position. Such an arrangement of two print images results when both a private/regional and the governmental/universal mail carrier are involved with the transport and letter delivery. The respectively selected pre-payment section 1 characterizing a federal/universal mail carrier is always printed only at a first position, the selected section 2 characterizing a private/regional mail carrier is always printed only at a second position, and the selected section 3 characterizing shipment types or product codes is always printed only at a third position.

Figure 4:
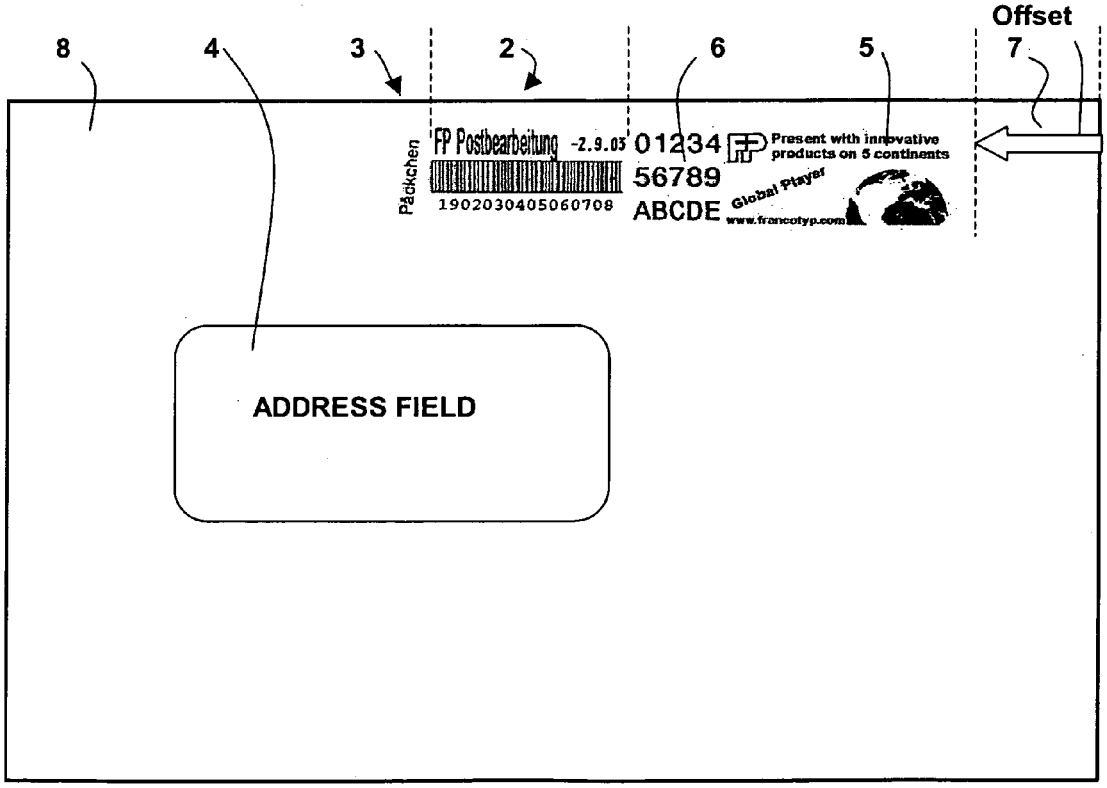
FIG. 4 shows a letter envelope with an offset print image of a private mail carrier with additional printed information.

FIG. 4 shows a letter envelope with an offset print image of a private mail carrier with additional printed information, as has already been explained in principle using FIG. 2. The offset 7 can be adjusted for large-format letter envelopes 8 by further selection means.

The selection means preferably are components of a user interface or of other suitable input means. For example, as softkeys are used in connection with the screen image shown by a display unit, with one of multiple functions being programmably associated with the keys of a keyboard. The printer means, display unit, input means and storage means are connected with the electronic control means, as known, for example, from German Utility Model 92 19 183 (U.S. Pat. No. 5,471,925) for franking machines. The data printed in predetermined sections of the print image on a strip or on a mail piece can be printed by a single franking machine or two franking machines. Alternatively, the second section can first be printed by a mail processing machine or by an office printer controlled via computer before the mail piece arrives at a franking machine that prints the first section of the print image in a known manner. The second section 2 then can also be printed by an office printer on an envelope together with the address field 4. In this special variant, the printing ink of the second section of the print image and the address field 4 can be identical. However, this rules out another variant in which the data of the second section are printed in a different ink, for example at the requirement of the private mail carrier. In another variant, the first section is printed the same by the office printer with the data of the federal mail carrier. The computer controlling the office printer is equipped with a mail processing function. The printing ink of the first and second sections of the print image and the address field 4 can be the same or different, corresponding to the mail carrier requirements.

The special postal information 20 is printed with an ink typical for the selected private mail carrier. The logo 5 and the sorter information 6 can be printed at the first position with the same ink typical for the selected private mail carrier or with a different ink.

However, if a window envelope is used, both sections 2 and 1, or 2, 5 and 6, can also then be printed by a single franking machine with a uniform ink.

Figure 5:
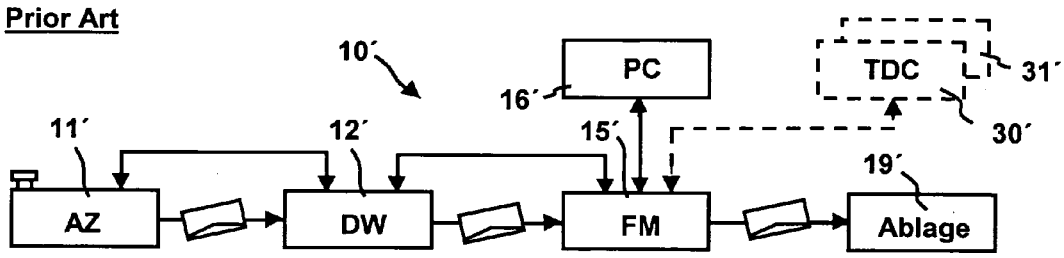
FIG. 5 is a block diagram of the franking system Jetmail® (prior art).

A block diagram of the known franking system Jetmail® is shown in FIG. 5. The already known franking system 10' is comprised of a franking machine 15' to which are connected (downstream) a deposit box 19' and (upstream) an automatic supply station 11' and dynamic weighing device 12'. Via supply station 11', a stack of mail pieces standing on edge are individualized and supplied to the dynamic weighing device 12'. The franked and stored mail pieces are stacked. A stack of situated mail pieces can be removed from the deposit box 19'. The automatic supply station 11', dynamic weighing machine 12' and a personal computer 16' are electrically connected via cables to a first and second interface of the franking machine 15'. The franking machine 15' can be communicatively connected with a separate telepostage data center 30' (shown dashed) for the purpose of credit downloading. The franking machine 15' is equipped with a postage calculator. A current postage fee table can be transmitted from a separate service center 31' to the franking machine 15' or franking system 10'.

Figure 6:
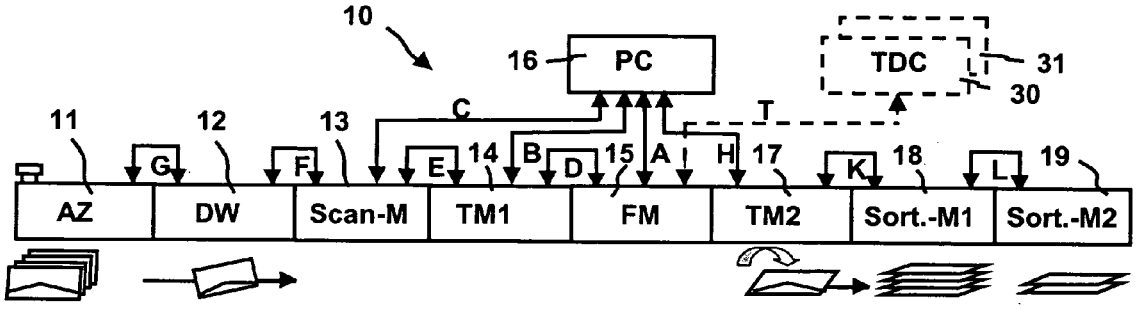
FIG. 6 is a block diagram of the franking system Jetmail® with a number of stations at the private mail carrier.

A block diagram of the franking system Jetmail® is shown in FIG. 6 with a number of stations for mail processing at the private mail carrier. Two stations are arranged between a dynamic weighing device 12 connected to an automatic supply station 11 and a franking machine 15. The first station is a scanner module 13 which scans the address field of a mail piece for a receiver address. The second station is a transport module 14 that can reduce the speed of a transported mail piece.

The personal computer 16 is connected (by an interface) via a cable A to the scanner module 13 and via a cable B to the transport module 14, as well as being electrically connected to the franking machine 15 via a cable C. Moreover, the franking machine is electrically connected (by an interface) to the transport module 14 via a cable D. The transport module 14 is electrically connected (by an interface) to the scanner module 13 via a cable E. The scanner module 13 is electrically connected (by an interface) to the dynamic weighing device 12 via a cable F. The dynamic weighing device 12 is electrically connected (by an interface) to the automatic supply station 11 via a cable G. The personal computer 16 is electrically connected (by an interface) to the transport module 17 via a cable H. The transport module 17 is electrically connected (by an interface) to a first sorter module 18 via a cable K. The first sorter module 18 is electrically connected (by an interface) to a second sorter module 19 via a cable L. The franking machine 15 is moreover electrically connected (by an interface) to a separate telepostage data center as well as service center 31 (shown dashed) via a telephone cable T.

When both a receiver address and a letter content are printed at the customer by a computer-controlled office printer and then each letter is inserted in a window envelope before the mail piece arrives at a franking system at the first mail carrier. The first mail carrier can supply the service of franking for the customer and the service of sorting for the second mail carrier. The customer thereby profits from a discount granted by the second mail carrier for sorted mail pieces.

A stack of mail pieces is situated at the automatic supply station 11 and is individualized. Each mail piece is weighed with the dynamic scale 12 and scanned in for the receiver address in the scanner module 13. The scanner module 13 delivers scanner data to the personal computer 16 via the interface cable C. If the receiver address scanned in the address field of a mail piece is recognized in the personal computer 16, then the station following in the mail stream maintains the previous speed of a transported mail piece. The aforementioned station is a transport module 14 which can reduce the speed of a transported mail piece until the scanned receiver address is recognized by the personal computer 16. The transport module 14 is correspondingly controlled by the personal computer 16 via the interface cable B in order to reduce the speed of a transported mail piece or, as necessary, in order to stop the transport. The transport module 14 can do this automatically. The interface cables D through G convey a message that the transport speed of a subsequently transported mail piece M should be kept as high as possible or should be reduced. The personal computer 16 receives a message via interface cable A of the value of the transport speed of a current mail piece M to be transported.

A two-level superimposed speed regulation is thereby provided dependent on at least one of the available parameters: computing power, calculation time for address correction or the amount of data to be printed. The corresponding parameter—for example pertaining to the amount of the data to be printed—is transmitted from the personal computer 16 to the franking system 10 via the interface cable A.

Alternatively, a decentralized control mode can be provided for the first transport module 14, such that the transport speed of a current mail piece M to be transported is maintained at the highest level, or is reduced dependent on the amount of data to be printed. In addition the parameter concerning the amount of data to be printed is transferred from the personal computer 16 to the first transport module 14 via the interface cable B, the transport module 14 including a microprocessor controller (not shown). The microprocessor controller is programmed to correspondingly change the transport speed for the current mail piece M to be transported and subsequently to be printed. The personal computer 16 controls the second transport module 17 via the interface cable H, such that the transport speed of a current mail piece M to be transported is raised to a predetermined value of the transport speed. Alternatively, a decentralized control mode can be provided for the second transport module 17, such that the transport speed of a current mail piece M to be transported is automatically raised to a predetermined value of the transport speed.

The personal computer 16 passes control and parameter data to the transport module 17 via the interface cable H, whereby control data that are not determined for the transport module 17 are forwarded (according to interface) to sorter modules 18, 19 via cables K and L.

The mail processor includes a scanner module 13, two transport modules 14 and 17 as well as at least one or more sorter modules 18 and 19 that can be controlled by the computer 16 dependent on its address evaluation means. Up to 98 matching bins that are arranged in the sorter modules below mail piece gates can thereby be operated for sorting purposes. A first transport module 14 transports mail pieces standing on edge while the a [sic] second transport module 17 transports mail pieces lying on their sides. The stations 13 and 14 newly added to the franking system Jetmail CONCORDE® are again such peripheral devices of the franking machine that are equipped with their own intelligence. They are thus essentially similar in their control and construction design to the design of the typical stations 11 and 12 of the franking system Jetmail®. The OCR scanner module 13 and the first transport module 14 comprise a transport unit (not shown) that corresponds to that of the dynamic scale 12 which, however, manages without its weighing cell. The transport unit has a back wall to guide the mail piece and a transport device with a conveyor belt on which the mail piece standing on edge is transported. The control (not shown) of the transport unit comprises a microprocessor which is connected with a program storage, with a non-volatile storage as well as with multiple interfaces for input and output. The microprocessor is—in a manner not shown—under normal operating conditions connected with a motor of the transport unit via an actuator with a speed sensor and with sensors in order to receive speed signals and sensor signals and in order to send control commands to the transport unit. The latter preferably includes a direct current motor which is fed with direct current pulses, whereby a specific rotation speed is set based on the ratio of the pulse length to the pulse pause. For example, the type M42x15 Gefeg drive technology is suitable as a direct current motor, and an encoder which is mechanically coupled with the former is suitable as a speed sensor. The motor can be connected with a drive roller for the conveyor belt via a suitable gearing. A first upstream sensor serves as an intake sensor and a second downstream sensor serves as an outlet sensor. An evaluation circuit which emits digital signals to the microprocessor belongs to the sensors. A sensor can, for example, be fashioned as a light (photoelectric) barrier.

Naturally, differently-designed stations of a different franking system can also be used. Alternatively, an optional variant for stations with standing or resting transport can also be provided corresponding to the requirements that exist in a different franking system in use.

Parameters, for example for the desired speed levels, are stored in the non-volatile storage of each of the stations, whereby a speed regulation at a predetermined desired speed is enabled by the control at a time interval between the point in time of leaving the automatic supply station 11 (AZ) and the point in time of leaving the franking machine 15 (FM). New parameters can be input and stored in the non-volatile storage via the interfaces. A control of the transport speed below a maximum speed that, in the given example of Jetmail CONCORDE® is Vmax=0.680 m/s, is therewith possible.

The Jetmail CONCORDE® enables the franking of a maximum of 3500 mail pieces per hour with mixed mail and of a maximum of 7000 mail pieces per hour at HiSpeed operation of formats through C5 and a maximum of 3 mm-thick mail pieces. The HiSpeed operation, meaning operation given deactivated weighing function and format recognition, is provided for mail pieces of the same format and weight, for example Infopost or advertisement mail.

The mail pieces arrive at the system per customer collected with a customer card for the system. The customer card contains customer information, barcode and (if necessary) further information and is, for example, scanned by the scanner module 13 or inserted into a chipcard reader. At least the customer information thus arrives in the system before the processing of mail pieces, which upon non-reading of the customer card is stopped. The collected mail pieces do not have to be presorted according to format or weight, which represents a decisive advantage of the mixed mail processing. After the format recognition in the automatic supply station and the weighing in the dynamic scale, an OCR unit reads the receiver address in the read window of the scanner module, insofar as this is machine-readable. The read window has the dimensions 15 mm by 145 mm from the upper edge of the letter with which each letter stands on the conveyor belt, up to 200 mm long in the transport direction. The mail piece (letter) is subsequently [sic] with the relevant data (barcode information, sorter information, date, carrier information, possibly customer logo), whereby 9 to 20 customer logos are stored in the franking system and a download of further or different customer logos is possible, for example via a chipcard.

The control of a franking system can ensue, for example, such that the franking machine 15 can print out a print image at defined speed grades, for example 0.4 m/s or 0.6 m/s, depending on whether an address scanned by the scanner module is processed or, respectively, must be corrected or is immediately correctly recognized.

The necessary address processing ensues in the personal computer 16 (PC) connected to the franking machine 15 (FM). A comparison with a databank must concretely ensue for each read address in order to establish whether it is a valid address. For this, for example, a plausibility check of a street name specified in the address for postal code is implemented. In the cases in which the read address is immediately classified as valid, the association to the sorting data ensues immediately, said sorting data then being alternatively also printed online on the mail piece as sorting information 6 (FIG. 2).

With regard to the PC processing time, it is critical when the read address cannot be immediately classified as a valid address because intelligent error correction mechanisms are now used in order to be able to optimally still determine a valid address. For example, corrections of street names can be implemented here, in particular when abbreviations have been used by the sender. This event is critical in two aspects: on the one hand, the corrected result should achieve an optimally high hit quota in order to not implement illegitimate (thus false) corrections (however, this problem should not be highlighted in detail at this point); on the other hand, this procedure requires calculation time; the result must, however, be present at the printing stations before arrival of the mail piece, since otherwise the sorting information could not be printed online. Instead of slowly, correspondingly adjusting the transport speed of the franking system once in order to be able to catch all of these "worst cases", a two-stage overlaid speed regulation of the franking system ensues. That has the advantage that the throughput of the franking system is not disadvantageously influenced, in particular when the problem cases constitute only a small portion of the total postal good amount. Such mail pieces, whose addresses must undergo a correction attempt, are normally seldom.

The two-stage overlaid speed regulation of the system first possesses a secondary speed regulation with which the system speed reacts to the tendential "quality" (meaning the portion of correction addresses) of the postal good amount. For example, if no "correction addresses" are present within a time span Δt or a quantity n, then the system speed is adjusted upwards to a maximum. As soon as a correction address emerges, the speed is adjusted downwards by the personal computer 16, and the greater the percentile of correction addresses that appear, the less the secondary speed.

A second superimposed speed regulation reacts very quickly to each individual letter. For example, it is conceivable but not very probable that, of 1000 letters, 999 letters have an error-free address and only one of the letters has a completely false address. In this case, the secondary speed regulation would be too slow in order to start a correction attempt for the address of the one letter. Therefore, the second superimposed speed regulation has the possibility to completely stop the system and to wait a defined maximum time for a correction result. The appertaining letter then typically also stops at a defined location, namely close to the transition between the transport module 17 (TM1) and the franking machine 15 (FM). The precise location is, however, insignificant for the basic implementation. The disadvantage of the stopping is naturally that a restart time is necessary to accelerate the system. Therefore, the combination of both speed regulation systems is thus advantageous because for both components:

a) the slow, secondary and tendential development and b) the short-term state are taken into account.

In addition to the quality of the letter, the secondary control also considers still-further criteria such as, for example, the computer capacity available. When, for example, in addition to the system processing other processes are also executed on the PC, then the whole computer capacity is not available to the system process and the secondary speed regulation would correspondingly react by slowdown of the transport speed. Other criteria for the speed regulation also can be relevant, such as, for example, the read mode: if it works with read windows (meaning a predefined address window region in which the address is located on the letter, which clearly accelerates the reading) or not, or if addresses are read at all or in fact barcodes are read, etc.

Figure 7:
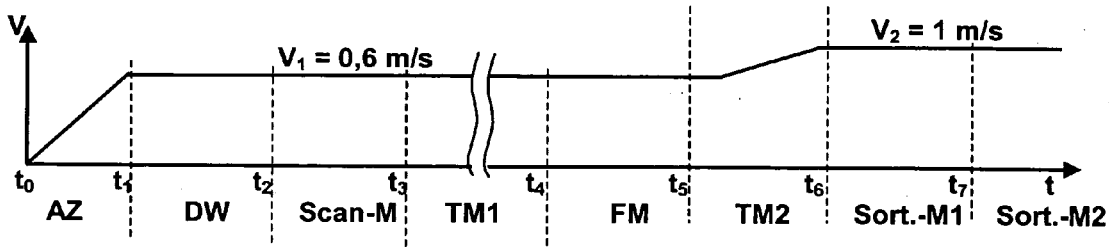
FIG. 7 is speed/time diagram of the franking system with correct receiver address.

FIG. 7 shows a speed/time diagram of the franking system with correct receiver addresses, whereby a speed regulation ensues at a first predetermined desired speed $V_1$=0.6 m/s in the time interval between the point in time $t_1$ upon leaving the automatic supply station 11 (AZ) and the point in time $t_5$ upon leaving the franking machine 15 (FM). In the transport module 17 (TM2) that is connected to the output of the franking machine 15, the transport speed is increased to a second predetermines desired speed $V_2$=1.0 m/s up to the point in time $t_6$ upon leaving the transport module 17 (TM2) and is maintained in the individual sorting modules 18, 19 . . . xx during the sorting process $t_6$, $t_7$ . . . $t_x$.

Figure 8:
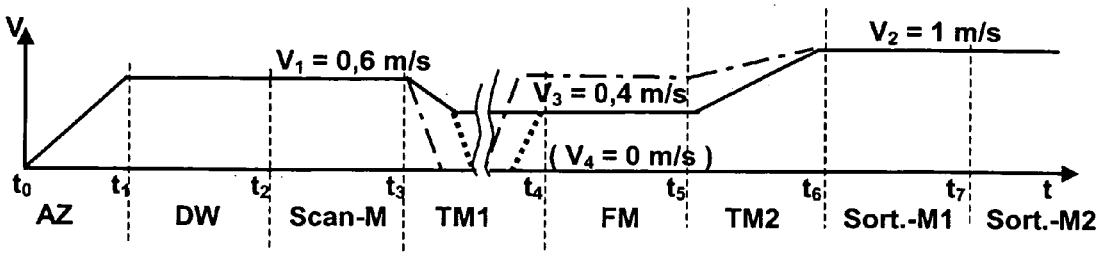
FIG. 8 is a speed/time diagram of the franking system with corrected receiver address.

A speed/time diagram of the franking system is shown in FIG. 8 with corrected receiver addresses. In a variant (continuous line), in the time interval between the points in time $t_3$ and $t_4$ (meaning before leaving the transport module 14 (TM1)) adjustment is made down to a third predetermined desired speed $V_3$=0.4 m/s, and the speed is maintained during the franking.

In another variant (dotted line), in the time interval between the points in time $t_3$ and $t_4$ (meaning before leaving the transport module 14 (TM1)) adjustment is made down to a fourth predetermined desired speed $V_4$=0 M/s, and thus the transport is stopped. The speed is adjusted up again to the third predetermined desired speed $V_3$=0.4 m/s after remedy of the problem of the address recognition and is maintained during the franking.

In a further variant (dash/dot line), in the time interval between the points in time $t_3$ and $t_4$ (meaning before leaving the transport module 14 (TM1)) adjustment is made down to the fourth predetermined desired speed $V_4$=0 m/s, and thus the transport is stopped. The speed is adjusted up again to the first predetermined desired speed $V_1$=0.6 m/s after remedy of the problem of the address recognition and is maintained during the franking.

Based on the fact that the predominant part of the transported shipments have been generated with a PC, in particular in the business field, it is assumed that a PC software generates a barcode in the address (window) field of the document that can be assuredly and reliably read in the subsequent processing with inexpensive barcode scanners (without OCR software). With this, not only is a significant simplification of the mail piece processing process achieved, but also the read reliability based on barcode redundancies is clearly improved.

That enables a significant simplification and therewith price-reduction of the subsequently mail processing process in connection with the sorting of mail. The saving on the part of the mail carrier can be passed on to the PC user in the form of discounts, whereby the purchase of the PC software is amortized. The latter is based on a table with the information about postal code, street name and house number and encodes this information in the already mentioned barcode. Based on this fundamental method, various embodiments are possible:

Checking of the address information for plausibility is possible.

In order to become independent of the different text processing programs, a post-processing in the printer driver is possible. Here the complete print information exists in a uniform format and the appertaining barcode can subsequently be inserted via evaluation of the address.

The software can store a user/identification number in the barcode in order to thus ensure the allowed discounting specific to letter and sender.

It is conceivable to also encode the names of the addressee or/and also the sender, and thus to enable a shipment tracking (up to the scanning of the shipment upon delivery).

Using the barcode information, a detailed billing for each customer is unproblematically possible.

The letter carrier can process unsorted mail; a pre-sorting and/or separation according to customer is foregone.

Certified mail documentation can be unproblematically realized on the part of the mail carrier.

The software can decide between national and international shipments and control the feature of barcode generation dependent on this.

The software is protected from pirate copies via a dongle.

The software can store pre-selected shipment types (job data) in the barcode.

The software can store check digits of the letter content in the barcode and thus generate certificates.

The invention allows significant improvements in established mail processing processes as well as providing for new services. Various embodiments of the inventive idea based on the above-mentioned aspects are conceivable, for example with varying barcodes, processing in the dongle, pay-per-click billing methods.

Although modifications and changes may be suggested by those skilled in the art, it is the intention of the inventor to embody within the patent warranted hereon all changes and modifications as reasonably and properly come within the scope of his contribution to the art.

I claim as my invention:

1. An arrangement for generating a print image for franking and postmarking machines, comprising:

a printer adapted to print on a postal item;

a storage unit for storing data representing information to be printed by said printer;

a selection unit connected to said control unit allowing selection of a logo and sorting information, and wherein said control unit controls said printer; and a control unit connected to said storage unit and to said selection unit for accessing the data stored therein, and for controlling said printer for printing postal information characterizing a private/regional mail carrier at a second position on said postal item, next to and to the left of a first position on said postal item, dependent on said selection for printing said logo and said sorting information at said first position.

2. An arrangement as claimed in claim 1 wherein said control unit causes said printer to print a date, a marking for a selected private/regional mail carrier, and an identifier for the postal item in said postal information at said second position.

3. An arrangement as claimed in claim 1 comprising a selection unit allowing selection of a private mail carrier or a federal mail carrier, said control unit being connected to said selection unit and causing information characterizing the selected private/regional mail carrier or the selected federal/universal mail carrier to be printed at a fixed, predetermined position on said postal item by said printer.

4. An arrangement as claimed in claim 3 wherein said control unit controls said printer to cause said printer to print information characterizing a federal/universal mail carrier at said first position and information characterizing said private/regional mail carrier at said second position.

5. An arrangement as claimed in claim 3 wherein said control unit causes information characterizing the selected private/regional mail carrier to be printed at said second position.

6. An arrangement as claimed in claim 1 wherein said printer prints said logo and said sorting information with an ink characteristic for said private/regional mail carrier.

7. An arrangement for generating a print image for franking and postmarking machines, comprising:

a printer adapted to print on a postal item;

a storage unit for storing data representing information to be printed by said printer;

a selection unit allowing selection of at least one of a product code or a shipping type; and a control unit connected to said storage unit and to said selection unit for accessing the data stored therein, and for controlling said printer for printing postal information characterizing a private mail carrier at a second position on said postal item next to and to the left of a first position on said postal item to print said at least one of said product code or said shipping type in a third position on said postal item, and to print said at least one of said product code or said shipping type in a third position on said postal item, to the left of and next to said second position.

8. An arrangement for generating a print image for franking and postmarking machines, comprising:

a printer adapted to print on a postal item;

a storage unit for storing data representing information to be printed by said printer; and a control unit connected to said storage unit for accessing the data stored therein, and for controlling said printer for printing postal information characterizing a private mail carrier at a second position on said postal item next to and to the left of a first position on said postal item with an ink that is characteristic of said private/regional mail carrier.

9. An arrangement for generating a print image for franking and postmarking machines, comprising:

a printer adapted to print on a postal item;

a storage unit for storing data representing information to be printed by said printer;

a control unit connected to said storage unit for accessing the data stored therein, and for controlling said printer for printing postal information characterizing a private mail carrier at a second position on said postal item next to and to the left of a first position on said postal item;

a mail processor connected to said control unit for determining data from said information printed on said postal item enabling processing and sorting of said postal item, said mail processor comprises a computer and stations of a franking system operationally connected with each other, said computer comprising an address evaluation unit for evaluating an address associated with said postal item and;

said stations including a scanner module, a transport module and a franking machine, said scanner module and said transport module being disposed upstream of said franking machine, said scanner module, said transport module and said franking machine being connected to and controlled by said computer dependent on said address evaluation.

10. An arrangement as claimed in claim 9 wherein said stations include a transport module and a sorting module and a franking machine, said transport module and said sorting module being disposed downstream from said franking machine, said transport module, said sorting module and said franking machine being connected to said computer and being controlled by said computer dependent on said address evaluation.

11. An arrangement for generating a print image for franking and postmarking machines, comprising:

a printer adapted to print on a postal item;

a storage unit for storing data representing information to be printed by said printer;

a control unit connected to said storage unit for accessing the data stored therein, and for controlling said printer for printing postal information characterizing a private mail carrier at a second position on said postal item next to and to the left of a first position on said postal item; and a mail processor connected to said control unit for determining data from said information printed on said postal item enabling processing and sorting of said postal item, said mail processor comprises a scanner module, a transport module and a sorter module connected to and controlled by said computer dependent on said address evaluation, said OCR scanner scanning a pre-printed address in an address region of said postal item, said address evaluation unit evaluating said address information for producing sorting information, and said transport module including a two-level superimposed speed regulation for transport of said postal item, dependent on the address evaluation time.

12. An arrangement as claimed in claim 11 wherein said transport module sets said two-level superimposed speed regulation dependent on at least one parameter selected from the group consisting of available computing power, calculation time for address correction, and amount of data to be printed.

* * * * *